US006461083B1

(12) United States Patent
Pionetti et al.

(10) Patent No.: US 6,461,083 B1
(45) Date of Patent: Oct. 8, 2002

(54) METHOD AND DEVICE FOR LINKING SURFACE TO THE SEABED FOR A SUBMARINE PIPELINE INSTALLED AT GREAT DEPTH

(75) Inventors: Regis Pionetti, Paris; Xavier Rocher, Chatou, both of (FR)

(73) Assignee: Bouygues Offshore, Saint Quentin en Yvelines (FR)

( * ) Notice: Subject to any disclaimer, the term of this patent is extended or adjusted under 35 U.S.C. 154(b) by 0 days.

(21) Appl. No.: 09/673,543

(22) PCT Filed: Feb. 17, 2000

(86) PCT No.: PCT/FR00/00389

§ 371 (c)(1),
(2), (4) Date: Oct. 17, 2000

(87) PCT Pub. No.: WO00/49267

PCT Pub. Date: Aug. 24, 2000

(30) Foreign Application Priority Data

Feb. 19, 1999 (FR) ..... 99 02269

(51) Int. Cl.[7] ..... E21B 43/017
(52) U.S. Cl. ..... 405/224.2; 166/350
(58) Field of Search ..... 405/224.1, 224.2, 405/224.3, 224, 195.1; 166/367, 355, 343, 350

(56) References Cited

U.S. PATENT DOCUMENTS 4,371,037 A * 2/1983 Arnaudeau ..... 166/366
4,391,332 A 7/1983 Fayren
4,459,066 A * 7/1984 van der Graaf ..... 405/195
4,462,717 A * 7/1984 Falcimaigne ..... 405/195
4,606,673 A * 8/1986 Daniell ..... 405/210
4,802,431 A * 2/1989 Pollack ..... 114/230
5,615,977 A * 4/1997 Moses et al. ..... 405/195.1
5,794,700 A * 8/1998 Pollack ..... 166/339
6,082,391 A * 7/2000 Thiebaud et al. ..... 137/236.1

FOREIGN PATENT DOCUMENTS

| | | | |
|---|---|---|---|
| EP | 0 802 302 A1 | 10/1997 | ..... E21B/17/01 |
| FR | 2 507 672 | 6/1981 | ..... E21B/17/01 |
| WO | WO 98/29638 | 7/1998 | ..... E21B/17/01 |

OTHER PUBLICATIONS

International Search Report (in French) dated May 26, 2000.

* cited by examiner

*Primary Examiner*—Heather Shackelford
*Assistant Examiner*—John Kreck
(74) *Attorney, Agent, or Firm*—Cohen, Pontani, Lieberman & Pavane

(57) ABSTRACT

The present invention relates to a bottom-to-surface link system for an underwater pipe installed at great depth, the system comprising:

firstly a vertical tower constituted by at least one float (5, 14) associated with an anchor system (6, 8, 16) and carrying at least one vertical riser (9, 15) suitable for going down to the sea bed (18); and secondly at least one link pipe (4, 3) extending from said float (5, 14) to a surface support (1). According to the invention, said link pipe is a riser whose wall is constituted by a rigid steel tube, and said float (5, 14) is installed at a depth situated below the last thermocline (29).

18 Claims, 9 Drawing Sheets

METHOD AND DEVICE FOR LINKING SURFACE TO THE SEABED FOR A SUBMARINE PIPELINE INSTALLED AT GREAT DEPTH

BACKGROUND OF THE INVENTION

1. Field of the Invention

The present invention relates to a bottom-to-surface method and system for an underwater pipe installed at great depth.

The technical sector of the invention is the field of manufacturing and installing rising production columns for underwater extraction of oil, gas, or other soluble or fusible materials or a suspension of minerals from an underwater well head for the purpose of developing production fields installed at sea off-shore. The main application of the invention lies in the field of oil production.

2. Description of the Related Art

The present invention relates to the known field of links of the type comprising a vertical tower anchored to the sea bed and having a float situated at the top of the tower, which float is connected to a floating support installed on the surface by means of a pipe whose own weight causes it to take up the shape of a catenary.

In the present description the production fields are considered as being oil fields. Once the underwater depth of such fields becomes large, they are generally worked from floating supports. The well heads are often distributed over the entire field and production pipes and also water injection lines and control command cables are placed on the sea bed going towards a fixed location having a floating support positioned vertically above it on the surface.

In general, the floating support has anchor means so as to enable it to remain in position in spite of the effects of current, wind, and swell. It also generally includes means for storing and processing oil and means for off-loading it to off-loading tankers, which arrive at regular intervals to take away the production. These floating supports are known as "floating production storage and off-loading" (FPSO) supports and the initials "FPSO" are used throughout the description below to designate such a support.

Such FPSOs are either anchored by a series of anchor lines running from each of the corners of the floating support, in which case the FPSO maintains a substantially constant heading regardless of surrounding conditions, or else an FPSO has a turret secured to its structure and anchored by a series of anchor lines. Under such circumstances, the FPSO is free to revolve relative to the turret, and it is the turret that maintains a constant heading; under such circumstances the FPSO takes up a heading that corresponds to the resultant of the forces due to wind, current, and swell on the hull of the vessel. In the following description, the bottom-to-surface links are described for the most part as being connected to the side of an FPSO that is anchored and that therefore has a substantially constant heading (as shown in FIG. 2), whereas if the FPSO has a turret, then they should be connected to the turret itself (as shown in FIG. 6).

The bottom-to-surface link pipe is known as a "riser", which term is used in the present description, and it can be implemented in the form of a pipe rising continuously from pipes placed on the sea bed and going directly to the FPSO, thereby giving rise to a catenary configuration whose angle relative to the vertical at the FPSO is generally in the range 3° to 15° (a catenary riser).

When the water depth is less than several hundred meters such links must necessarily be made using pipes that are flexible, however once the depth reaches or exceeds 800 m to 1000 m, flexible pipes can be replaced by pipes that are strong and rigid, being constituted by tubular elements that are welded or screwed together and made of rigid material, such as composite material or thick steel. Such rigid risers of thick strong material and taking up a catenary configuration are commonly referred to as "steel catenary risers" (SCRs) and the initials SCR are used in the present description regardless of whether the riser in question is made of steel or of some other material such as a composite.

A flexible pipe and an SCR type rigid riser when subjected to the forces of gravity only, and when they are of the same height, present the same angle relative to the vertical where they connect to the FPSO, and have the same curvature over their entire suspended length. Mathematically, this curve is accurately defined and is known as a "catenary". However, SCRs are much simpler than flexible pipes technically speaking and they are much less expensive. Flexible pipes are structures which are complex and expensive and which are made from multiple spiral-wound sheaths and composite materials.

The depth of certain oil fields is greater than 1500 m and can be as great as 2000 m to 3000 m. The tension induced at the FPSO by each SCR can be as great as 250 metric tonnes to 300 tonnes and the large number of risers needed to develop certain fields leads to reinforcing the structure of said FPSOs considerably, and can give rise to unbalance if starboard and port loading is not the same. In addition, during circular movements of the FPSO about its mean position, the catenary formed by an SCR changes and the point of contact on the sea bed moves forwards and backwards and also from left to right at the same rate as the FPSO moves, putting down or picking up a portion of the pipe. These movements are repeated over long periods of time and they dig a furrow in poorly consolidated beds of the kind commonly encountered at great depth, thereby modifying the curvature of the catenary and leading, if the phenomenon amplifies, to risks of the pipes being damaged, i.e. the underwater pipes can be damaged and/or the SCRs can be damaged.

Because of the multiplicity of lines that exist in installations of this type, it is preferred to use a solution of the tower type in which the pipes and cables converge on the foot of a tower and rise up the tower, either all the way to the surface, or else to a depth that is close to the surface, with flexible pipes then extending from that depth to provide links between the top of the tower and the FPSO. The tower is then provided with buoyancy means so as to keep it in a vertical position and the risers are connected at the foot of the tower to the underwater pipes via flexible coupling sleeves which accommodate the angular movements of the tower. The resulting assembly is commonly referred to as a "hybrid riser tower" since it makes use of. two technologies: firstly a vertical portion, the tower, in which the riser is constituted by rigid vertical pipes; and secondly a top portion of the riser which is constituted by flexible pipes in a catenary configuration connecting the top of the tower to the FPSO.

French patent FR 2 507 672, which corresponds to U.S. Pat. No. 4,462,717, discloses such a hybrid tower comprising a surface float connected to the FPSO via flexible pipes and carrying suspended guides through which there pass solely the top portions of the vertical fluid transfer pipes. The hybrid tower is anchored to the sea bed by a cable under tension that gives the assembly a certain amount of flexibility in vertical movement, the bottom portions of the pipes being free and forming bends at the sea bed, against which they bear.

The advantage of such a hybrid tower lies in the freedom allowed to the FPSO to move away from its normal position while giving rise to a minimum amount of stress in the tower and in those portions of the pipes that are in the form of suspended catenaries, whether at the sea bed or at the surface. The FPSO is generally anchored by means of a multitude of lines connected to a system of anchors resting on the sea bed. Such an anchor system gives rise to return forces that maintain the FPSO in a neutral position. The bottom-to-surface links give rise to additional vertical and horizontal forces which have the effect of offsetting the axis of the FPSO relative to said neutral position. In the absence of current, wind, or swell, and when the tide is at its mean level, the position of the FPSO corresponds to a "reference position" $P_0$. Under the combined effects of environmental conditions, both on the hull of the FPSO and also on the various elements constituting the risers, the FPSO will move away from said reference position in proportion to the resultant of all the forces applied to the system.

Thus, for forces on the hull of the FPSO tending to move it away from the axis of the tower, the following effects are observed: firstly the catenary is stretched and its angle relative to the vertical at its point of attachment to the FPSO increases, thereby increasing the vertical and horizontal forces on the FPSO; and secondly the angle of inclination of the tower due to said horizontal force also increases.

In order to minimize the consequences of FPSO excursions, it is general practice to increase the stiffness of the anchor system and to provide flexibility in the bottom-to-surface links. For this purpose, the tower configuration associated with the catenary has a large capacity to absorb FPSO excursions, while minimizing movements of the tower and deformation of the catenaries.

To damp the movements of the FPSO, it is desirable to increase the curvature of the pipe that connects it to the top of the tower. Flexible pipes are believed to be better adapted to making links between an FPSO and the top of a tower. In prior embodiments of "hybrid towers" as described in FR 2 507 672 or in other types of structure such as those described in U.S. Pat. No. 4,391,332 and EP 0 802 302, use is made of plunging flexible pipes, i.e. pipes that go down to a depth well below the float before subsequently rising again. This is possible since a flexible pipe is capable of withstanding fatigue even when its curvature presents a radius of curvature of only a few meters.

However, the internal structure of flexible pipes is very complex and their cost very high, that is why prior embodiments of hybrid towers have sought to raise the tower as close as possible to the surface while nevertheless avoiding the turbulent zones at the surface, i.e. the top of the tower is to be found at a depth that is generally no more than 200 m, and preferably about 50 m. This makes it possible use short lengths of flexible pipe that are therefore less costly, and above all this makes it possible to ensure that the connections between the flexible pipes and the top of the tower are made more accessible to divers.

All of the elements of such hybrid towers or of such catenary risers must be dimensioned so as to be capable of withstanding swell, current, and movements of the surface vessel under extreme sea conditions, which leads to immersed structures of considerable size capable of withstanding high levels of stress and of withstanding fatigue phenomenon throughout their lifetime, which commonly reaches or exceeds 20 years.

SUMMARY OF THE INVENTION

The problem posed is thus to be able to make and install such bottom-to-surface links for underwater pipes at great depth, e.g. deeper than 1000 meters, and of the type comprising a vertical tower anchored to the sea bed and whose top float is connected to a floating support installed on the surface via a pipe in the form of a catenary, while nevertheless limiting forces on the floats and the pipes connecting it to the floating support, the entire system being capable of withstanding the stresses and fatigue while nevertheless accommodating large displacements of the surface support without requiring structures that are large and too expensive, and which should be capable of being put into place easily and reversibly so that they can easily be maintained and replaced.

A solution to the problem posed is a bottom-to-surface link system for an underwater pipe installed at great depth, the system comprising firstly a vertical tower constituted by at least one float associated with an anchor system and carrying at least one vertical riser connecting the float to the sea bed and capable of being connected to underwater pipes resting on the sea bed, and secondly at least one link pipe extending from said float to a surface support, such that, according to the present invention, said link pipe is a riser whose wall is a strong rigid tube, in particular made of steel or of composite material.

For a rigid pipe, the minimum acceptable radius of curvature is 10 to 100 times greater than that of a flexible pipe. To limit fatigue, it is accepted that the radius of curvature of a rigid pipe made of steel should generally be greater than about 100 m. To provide flexibility and achieve identical capacity to absorb the movements of the floating support and the movements of the tower, the fact that the catenary is less curved when using a rigid pipe is compensated by increasing the distance between the floating support and the float at the top of the tower, and thus by increasing the length of the rigid pipe. However, the apparent weight in water of a rigid pipe is greater than that of a flexible pipe, so the load at the float and the forces on the float at the top of the tower are therefore increased. This could lead to the float being overdimensioned, thereby leading to high levels of cost. That is why it is preferable, in accordance with the present invention, to install the top float of the tower at a greater distance from the surface of the water, and in particular at a depth that is below the last thermocline (where "thermocline" is defined below), and preferably not less than 100 m beneath the last thermocline. In particular, the top float of the tower is installed at least 300 m below the surface of the water, and preferably at least 500 m below the surface of the water, and more preferably at a depth that is greater than half the depth of the water in which the tower is anchored.

By lowering the top float of the tower in this way, the following advantages are obtained simultaneously:

- the length of the rigid pipe providing the link between the FPSO and the top of the tower is increased, thereby providing greater damping of the movements of the tower and of the FPSO;
- the minimum acceptable radii of curvature for a rigid pipe in a catenary are nevertheless complied with, regardless of how much the system as a whole moves; and
- costs are minimized since for a shorter tower the underwater structure is less massive and therefore less expensive and the float required for putting it under tension is smaller and therefore less expensive, and this is true in spite of the increase in the apparent weight in water of the pipe associated with its increased length. This is because the catenary does not rise or rises very little towards the float, so the weight of the rigid pipe constituting the catenary is essentially supported directly by the FPSO.

Nevertheless, maintaining a tower of a certain height, in particular not less than 50 m and preferably not less than 100 m is advantageous since by being able to move the tower contributes to damping the system under the effect of movements of the FPSO.

In a preferred embodiment, the anchor system has at least one vertical tendon, a bottom foot unit to which the bottom end of the tendon is fixed, and at least one guide through which the bottom end of said vertical riser passes. More particularly, the guide can be on the foot unit. Advantageously, said tendon also has guide means distributed along its entire length, through which at least said vertical riser passes.

Said foot unit can merely be placed on the sea bed and stay in place under its own weight, or else it can be anchored by means of piles or any other device suitable for keeping it in place; the float is connected to said foot unit via a flexible connection situated at the foot and via an axial link constituted either by a cable or by a metal bar or indeed by a pipe. The axial link is referred to in the present description as a "tendon".

In a preferred embodiment, the top end of the vertical riser is suspended through at least one guide secured to the float, placed within the float, or at the periphery thereof. The top end of the vertical riser is connected via the top of the float to the bend at the end of the link pipe, and the bottom end of the vertical riser is suitable for being connected to the end of a connection sleeve that is likewise bent, and that is movable between a high position and a low position relative to said foot unit. The sleeve is suspended from the foot unit and is associated with return means urging it towards its high position in the absence of the riser, the return means possibly being constituted by a counterweight. By having a connection sleeve that is movable in this way, variations in the length of the riser under the effects of temperature and pressure can be accommodated.

At the top of the vertical riser, an abutment device secured to the riser bears against the support guide installed at the top of the float and thus supports the entire riser: the riser is then suspended with its apparent weight in water being supported by part of the buoyancy of the float.

In a particular embodiment, each of said guide means distributed along the entire length of the tendon and through which said vertical riser passes comprises a cylindrical cavity, preferably surmounted by a conical funnel, with the inside diameter of the cylindrical cavity being greater than the diameter of the vertical riser, and each of said guide means has a flexible membrane secured to the inside wall of its cylindrical cavity, thereby creating a leakproof bag between said membrane and said inside wall, which bag can be filled with a fluid, preferably of very high viscosity, so as to bear against the riser.

Friction shoes are preferably associated with said membrane so as to bear against the riser when said bag is filled with fluid. The shoes thus enable the vertical riser to slide when its length varies under the effects of temperature and pressure.

The objects of the present invention are also obtained by a link method making use, as explained above, firstly of a vertical tower constituted by at least one float associated with an anchor system and carrying at least one vertical riser suitable for going down to the sea bed, and secondly at least one link pipe from said float to a surface support, whereby, in the present invention, said float is immersed at a depth situated below the last thermocline (where "thermocline" is defined and explained below), and said float is connected to the surface support via at least one strong rigid riser constituting one of said link pipes.

In a preferred implementation of the link method of the invention:

- a foot unit is put into place on the sea bed and secured to said bed; the bottom end of a tendon is secured thereto with the opposite, top end of the tendon being secured to said float, the assembly constituting said anchor system of the vertical tower;
- said vertical riser is progressively lowered e.g. from a floating support located vertically above said float, through one of the guide assemblies thereof until its top end comes to bear against said float, its bottom end then being connected to the top end of a coupling sleeve preinstalled on said foot unit.

As it moves down, the vertical riser preferably passes in succession through a series of guides secured to the axial link, referred to as a "tendon", thereby ensuring that it is held in a position that is substantially parallel to said tendon and to the other vertical risers, whether already installed in adjacent guides, or to be installed at a later date.

In a particular implementation, said float is installed so as to be immersed at a depth that is greater than half the depth of the water in which the tower of the invention is anchored, thus making it possible to assemble the entire vertical riser prior to installing it and to transport it to a position vertically above the guide corresponding to the float so as to be lowered therethrough.

The result is a novel bottom-to-surface link method for an underwater pipe installed at great depth and satisfying the problem posed.

Studies of sea currents in various seas over the world show that various layers exist starting from the surface and going down to the sea bed. Thus, at depths in excess of 500 m to 1000 m, in an Atlantic Ocean type configuration, the following is observed, as shown in FIG. 1:

- a surface layer $\mathbf{18}_1$ that can go down to about 50 m below the surface 19 and in which currents are local and mainly due to wind and tide phenomena. In this zone, currents are large and substantially uniform over the depth of the layer. They can have speeds of as much as 2.5 meters per second (m/s) off West Africa;
- a transition zone $\mathbf{29}_1$ known as a "thermocline", can be of various thickness but which is always of small thickness (3 m to 10 m). In this transition zone 291, the current falls off quickly to match the speed of the intermediate layer;
- an intermediate layer 182 in which currents lie in the range 0.5 m/s to 1 m/s. This intermediate layer extends from about −55 m to about −150 m and the currents are mainly thermal currents due to climatic phenomena;
- a second transition zone $\mathbf{29}_2$ or "thermocline" which is likewise of various thicknesses but always of small thickness (≈10 m). In this transition zone, current falls off quickly to match the current in the bottom layer; and
- a bottom layer $\mathbf{18}_3$ in which currents are small, generally not exceeding 0.5 m/s. These currents are due to intercontinental movements of water. This layer begins at about −150 m to about −170 m and it continues all the way down to the sea bed 12, i.e. down to depths that can be as great at 1000 m to 3000 m, depending on location.

In certain seas, three ethermoclines 29 can be observed in the upper portion, but as a general rule the bottom layer $\mathbf{18}_3$ begins at around −170 m to −200 m.

Thus, since the tower and its float in accordance with the invention and as described below are located below the bottom thermocline $\mathbf{29}_2$ they are to be found in a layer of water $\mathbf{18}_3$ that gives rise to the smallest stresses due to current. In addition, the float is protected from the effects of swell, which effects fall off quickly with depth, and it is common practice to ignore them once the depth exceeds 120 m to 150 m. The forces to which the tower is subjected are thus considerably reduced and substantially uniform over its entire height since they are due to intercontinental deep currents.

The system of the invention constituted by a tower associated with an SCR thus provides much better behavior in response to environmental conditions, both ordinary conditions and extreme conditions such as once-yearly conditions, 10-year conditions, and 100-year conditions. The forces and the stresses are very considerably reduced and the fatigue behavior of the various critical components is considerable increased, thereby making it possible to deliver better service throughout the lifetime of the field.

The float is thus at considerable depth, and it can be connected to the FPSO via at least one SCR instead of being connected via a flexible link as is the present practice. SCR links are simple and in addition, the internal structure of the SCRs, the vertical risers, and the pipes resting on the sea bed can then be identical, thereby simplifying the passage of cleaning scrapers. It is essential for such cleaning scrapers to be passed frequently when solid deposits such as paraffin or hydrates occur, and it must be possible to take action in repeated and highly energetic manner without damaging the inside surfaces of the risers and the pipes.

In general, the float is installed at about half the total water depth, but it could be installed higher or lower in order to take advantage of certain situations as described below. In any event, the float is never situated close to the last thermocline as described above but always at some greater depth, e.g. 100 m below it, so as to ensure that it runs no risk of being subjected to the disturbances generated by the thermocline, nor to the currents that exist in the top layer in the event of planet-wide disturbances in sea currents significantly altering ocean movements.

The SCR is connected to the vertical riser at the top of the float via a flexible joint which enables the angle between the axis of the tower and the axis of the catenary at said flexible joint to vary widely without imparting significant stresses to the SCR or to the top of the float. The flexible joint can either be a ball-and-socket type joint with sealing gaskets, or else it can be a layered ball made up of a sandwich of elastomer sheets and metal sheets bonded together and capable of absorbing large amounts of angular movement by deforming the elastomers while nevertheless maintaining complete leakproofing because of the absence of any rubbing surfaces, or indeed it could be a short length of flexible pipe capable of providing the same service.

The system of the invention is advantageously fitted with an automatic connector situated at the flexible joint, either between the tower and the flexible joint or between the flexible joint and the FPSO. Thus, such an SCR can be installed in a manner that is entirely automatic without requiring the use of divers. The installation sequence then consists in installing the tower, then in transporting the future SCR in a vertical position, and fixing it to the side of the FPSO in its final position. A cable connected to the bottom end of the future SCR is then manipulated by a remotely operated vehicle (ROV) so as to be brought to the top of the tower and so as to be connected to hauling means secured to the float and controlled e.g. by the ROV which then supplies the necessary power while also monitoring operations by means of video cameras whose signals are taken to the surface for use by operators located on a floating service vessel. The cable is then hauled in and the end of the SCR fitted with the male endpiece of an automatic connector (for example) is brought up to the female endpiece of the same automatic connector. At the end of the approach stage, the assembly is locked together and the hauling means are released so as to be capable of being used for installing the next line. The principle of automatic connectors is well known to the person skilled in the art of hydraulics and pneumatics, and is therefore not described in greater detail herein.

This method of installation presents the advantage of being entirely reversible, insofar as the automatic connector is designed to be capable of being disconnected. It is thus possible, in operation, to act on a single SCR for the purpose of disconnecting it and replacing it without disturbing the rest of production, and thus without any need to stop production on adjacent risers and SCRs.

Similarly, the tower and the vertical risers are advantageously installed using the following sequence:

- the foot unit is put into place and secured to the sea bed;
- a tendon fitted with guides and with the top float is installed;
- the assembled vertical riser is transported in the vertical position so as to be vertically above its guide situated in the float;
- the vertical riser is lowered progressively through its guides with the lowering operations being monitored from the surface;
- at the end of being lowered, the head of the riser rests on the top of the float and includes a bend and also, for example, the flexible joint which has the female portion of the above-described automatic connector secured thereto; and
- the bottom end of the vertical riser is also advantageously fitted with an automatic connector, preferably with the male portion thereof because it is smaller, and the assembly can be connected to the end of the underwater pipe connecting the foot of the tower to one of the well heads, said end being fitted with the female portion of said automatic connector.

Installing the vertical risers in this way presents the advantage of being entirely reversible, insofar as the automatic connector at the foot of the riser is likewise designed to be capable of being disconnected. It is thus possible in operation to act on a single riser so as to remove it and replace it without disturbing the rest of production, and thus without any need to stop production in adjacent risers and SCRs.

Insofar as the float is installed at a depth of more than half the total depth of the water, the fully assembled riser can be transported in the vertical position and lowered through the float. If the float is higher than half the depth of the water, the vessel used for installing the riser should be positioned vertically above the float and elements of the riser should be assembled to one another as the bottom end thereof is lowered through the float and the various guides installed along the tendon, with such assembly being implemented, for example, by welding, by adhesive, or indeed by mechanical assembly such a screwing, bolting flanges together, or crimping. In a preferred version of the system, a preassembled length of riser is transported in the vertical position from an assembly site that is remote from the tower, said length being shorter than the depth of water that remains between the surface and the top of the tower. In this way, the service vessel can take up position vertically above the float with a good length of riser pre-assembled and fitted at its bottom end with the male portion of the automatic connector, ready to be lowered towards and through the float and through the various guides installed along the tendon. As it moves down, the missing top portion of the riser is assembled as described above.

The above-described method of operation makes it possible to minimize the length of time the service vessel is present in the vicinity of the tower, thereby minimizing the risk of accident. Thus, in order to be able to take action at a later date and remove the riser in simple manner, it is preferable to use assembly methods that are suitable for rapid and non-destructive disassembly, such as screwing, thereby enabling the riser to be extracted from its supports, enabling it to be disassembled by unscrewing successive segments of the top portion, but only in sufficient numbers to release the bottom portion of the riser from the top of the float, after which the service vessel can change position together with the remainder of the riser suspended therefrom, heading for a location that is remote from sensitive installations prior to terminating maintenance operations.

In order to minimize the presence of the service vessel vertically above the tower, it is advantageous to install the float at a depth that is greater than half the total depth of the water, thus making it possible for the service vessel to install or extract an entire riser without needing to assemble or disassemble any of its components, thereby further reducing the risk of accident in the vicinity of the tower and of the sensitive installations.

Other characteristics and advantages of the present invention will appear better on reading the following description given in illustrative and non-limiting manner with reference to the accompanying drawings, in which:

Figure 1:
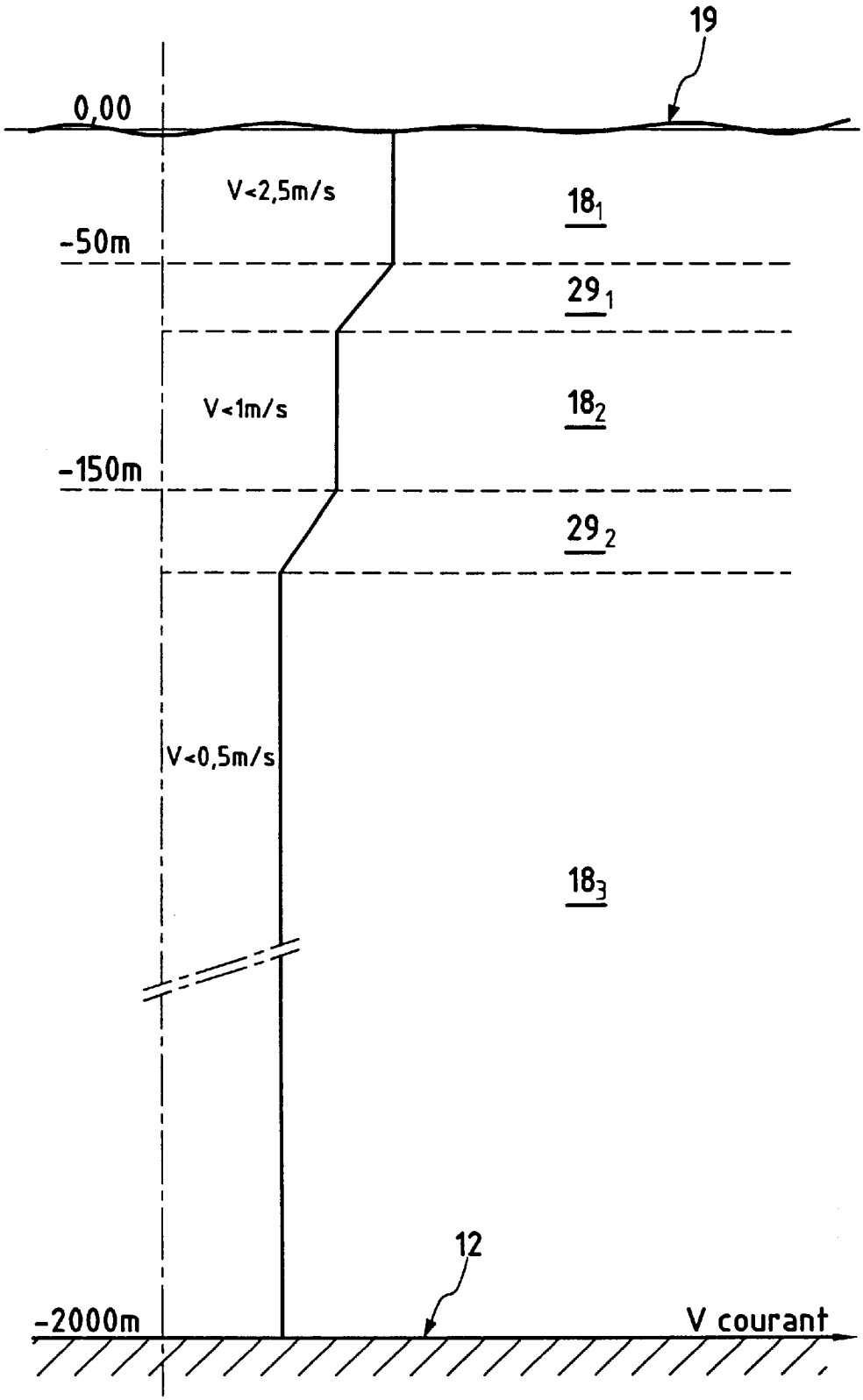
FIG. 1 is a diagram of the entire water depth in an Atlantic Ocean type configuration as previously described, with indicative current values in meters per second (m/s) being given along the abscissa and with the approximate depths of the various layers and corresponding thermal times being given up the ordinate.

In the drawings, elements that are identical or similar are given the same references from one figure to another, unless stated otherwise.

DETAILED DESCRIPTION OF THE PRESENTLY PREFERRED EMBODIMENTS

Figure 2:
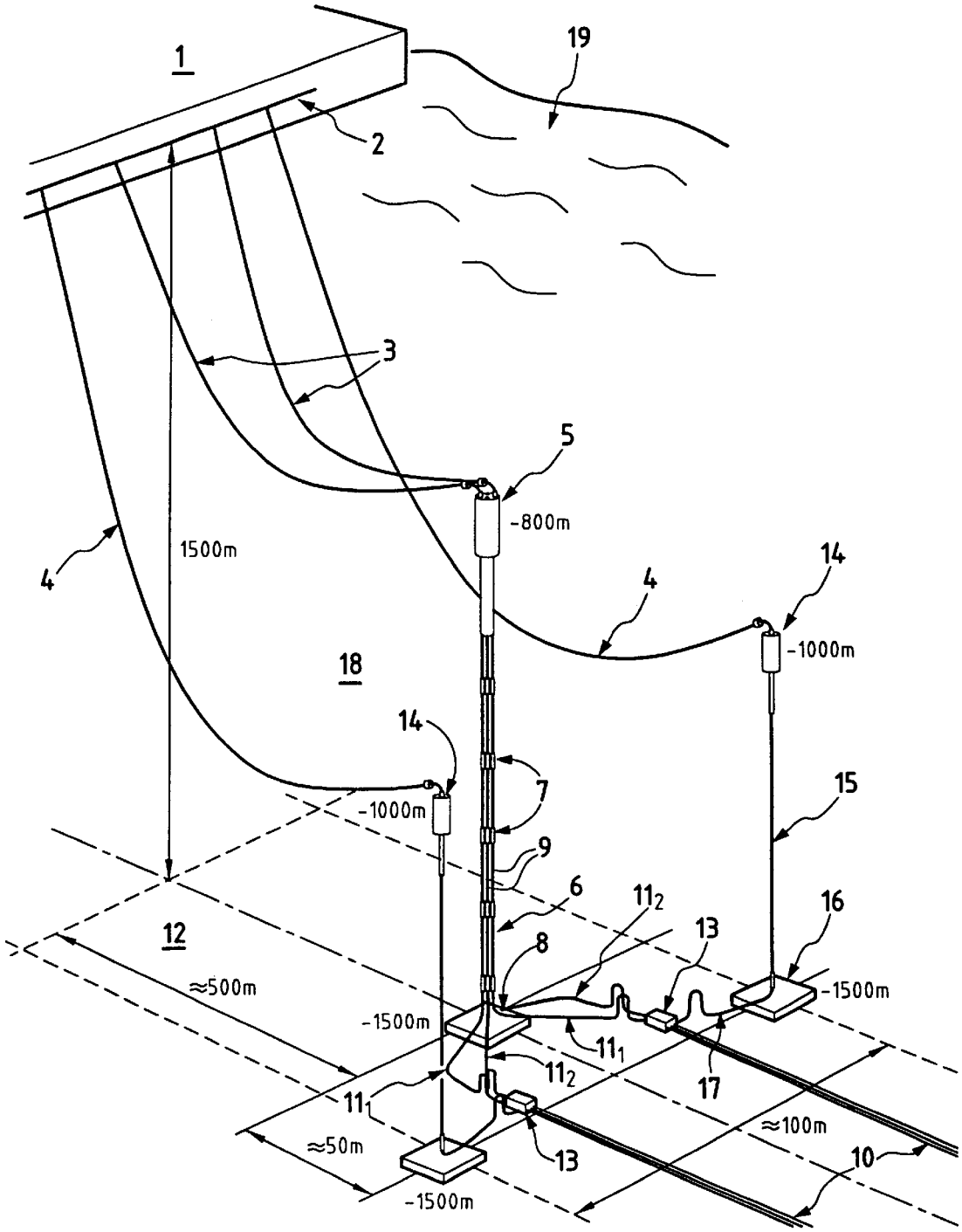
FIG. 2 is a perspective view of an oil field development at a depth of 1500 meters (m), with the FPSO being shown at the surface, a central tower for recovering oil effluent, and two lateral towers for injecting water.

FIG. 2 shows an FPSO 1 anchored over an oil field at a depth of 1500 m under water 18, by means of an anchor system (not shown) and including, for example, on its port side, a support system 2 for supporting SCR pipes for petroleum effluents 3 and water injection pipes 4. The petroleum effluent SCRs are connected to a tower, e.g. situated at −800 m from the surface 19, via the top of the float 5 that has four through positions, only two of which are occupied. Said float is connected to the foot unit 8 on the sea bed by means of a tendon 6 having a multitude of guides 7 fixed thereto, with risers 9 being installed therethrough, the risers being connected at the foot unit to connection sleeves $\mathbf{11}_1$ themselves connected to underwater pipes 10 via an intermediate connection block 13; other connection sleeves $\mathbf{11}_2$ are ready for corresponding vertical risers to be installed.

Two identical water injection towers are each constituted by a float 14 installed at −1000 from the surface and connected to a foot unit 16 by means of a riser 15 that also performs the tendon function. A connection sleeve 17 provides the link between the bottom of the riser and the intermediate connection block 13.

The float of the petroleum effluent tower which is at −800 m from the surface, for example, is located at lateral distance of about 500 m from a point vertically below the side of the FPSO for an SCR link in the form of a catenary that reaches the float horizontally, thus greatly facilitating installation and maintenance operations by a surface vessel, without interfering with the ordinary running operations of the FPSO. In addition, said surface vessel can take up station vertically above the tower and can maneuver without running the risk of fouling the permanent anchor lines of said FPSO. Since the float 14 of the water injection tower is at −1000 below the surface, i.e. at a greater depth than the above tower, it is located at 550 m from the side of the FPSO.

Figure 3:
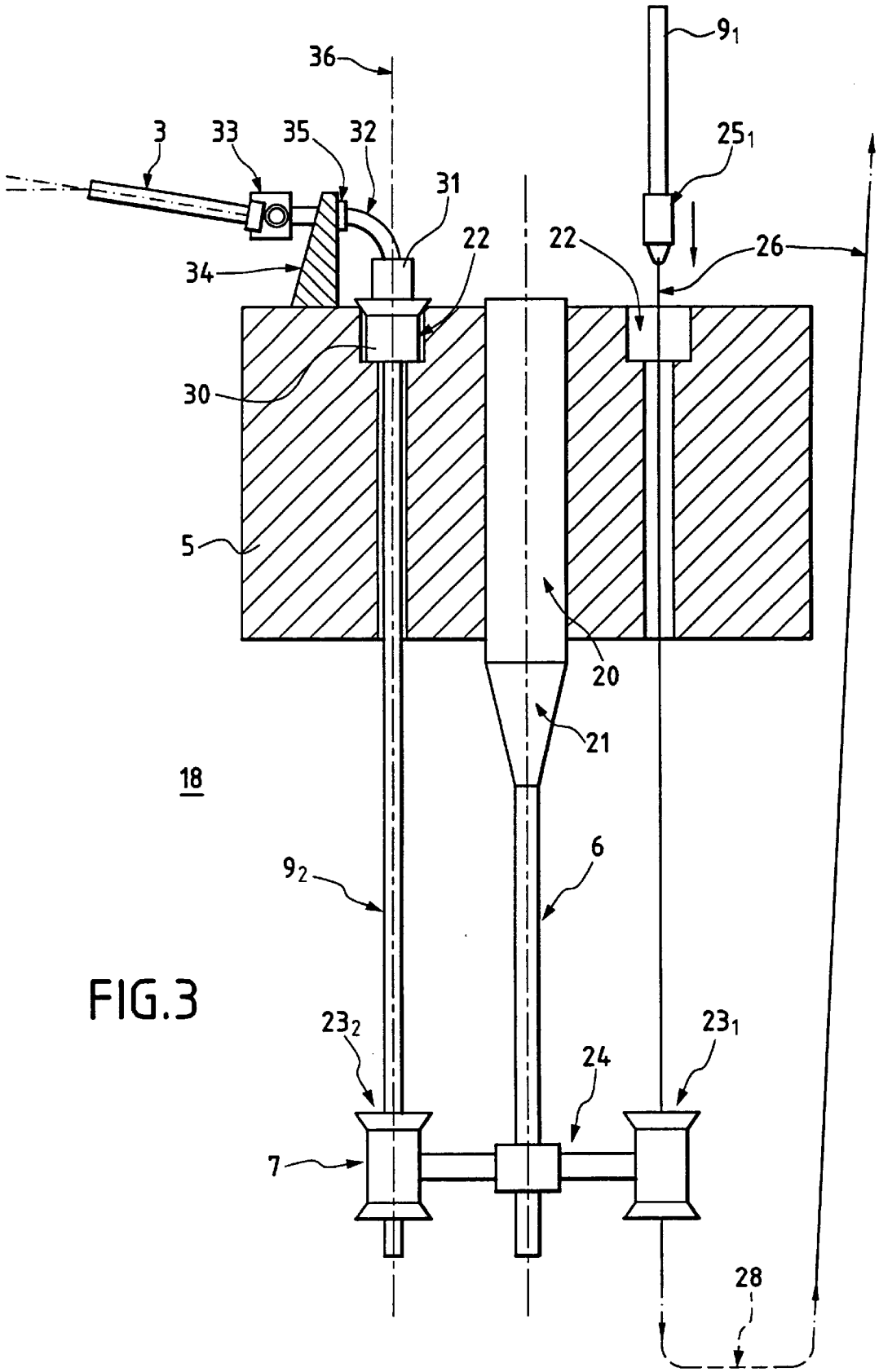
FIG. 3 is a section view through the float associated with a side view of the central tendon and of the two risers.

FIG. 3 is a section view of the float 5 of a multiriser tower associated with a side view of the various associated components. The float 5 is constituted, for example, by a caisson filled with syntactic foam and it is connected to the central tendon 6 via a link device 20 having a variable inertia piece 21 at its bottom end for transmitting stresses between the tendon and the float. The float has hollow vertical guides 22 in alignment with the guide means 23 of the guide 7 installed at (optionally regular) intervals along the tendon 6 and secured thereto by means of a fastener device 24. The guides 22 can either be integrated within the float, or they can be installed on its periphery, or indeed on its central portion. The guides receive the vertical risers 9 that are shown on the left of the figure as being fully installed and connected to the SCR link pipe 3, and on the right of the figure at the beginning of insertion of the male end 25 of an automatic connector for a riser 9.

Figure 4:
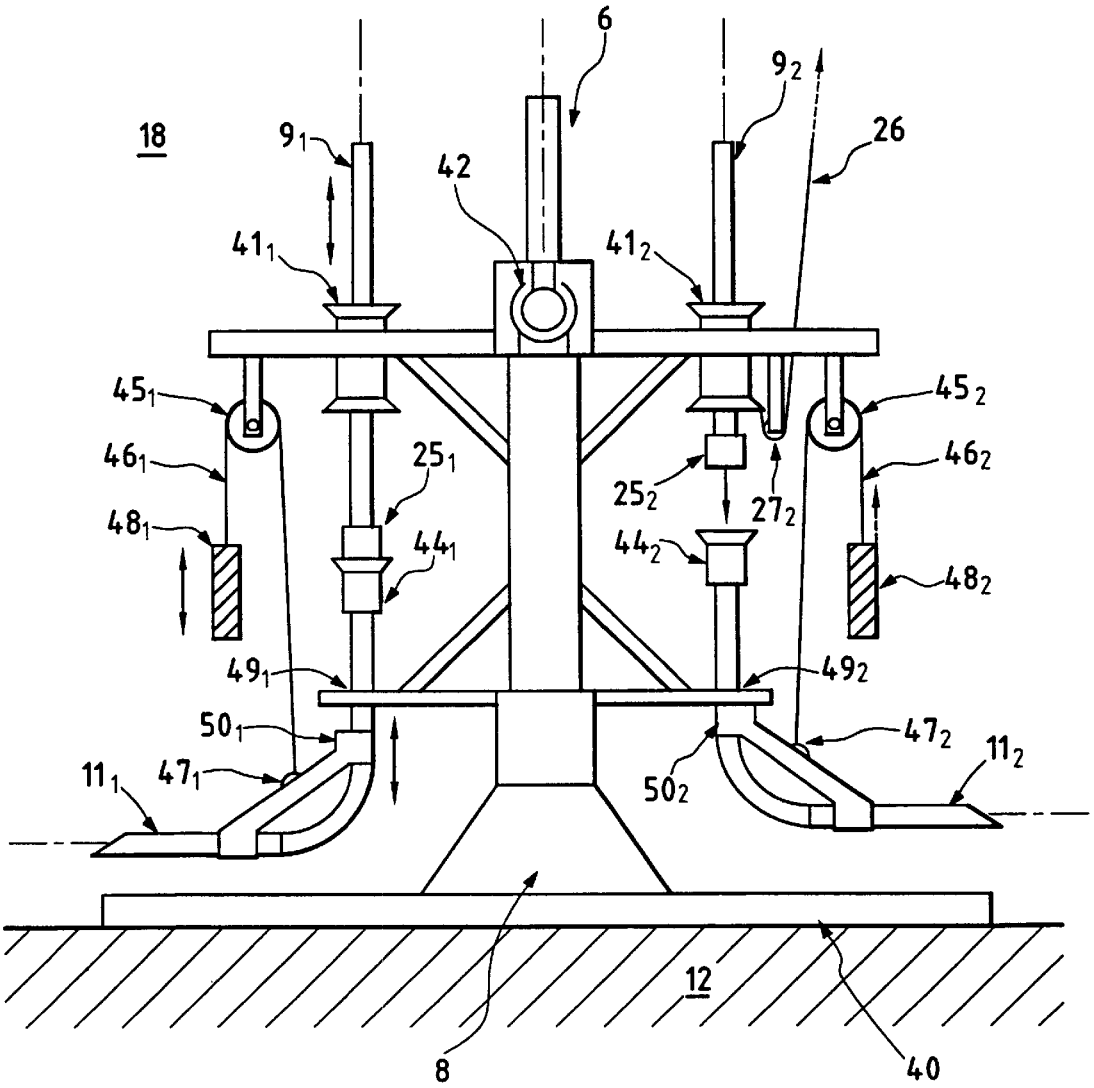
FIG. 4 is a side view of the foot units of the tower including two risers, the central tendon, and two sleeves for coupling to the underwater pipes.

The end of said automatic connector 25 is connected to a leader cable 26 passing through each of the guides 22, 23 down to the foot unit 8 of the tower where a return pulley 27 is installed. The foot unit 8 and the pulley 27 shown in FIG. 4 are represented in FIG. 3 by a dashed cable return line 28. The cable 26 rises to the surface to the service vessel where it is kept under tension by a constant tension winch. Thus, the service vessel is located vertically above the tower with the riser 9 fully assembled since the −800 m depth of the float 5 in this example is greater than the 700 m length of the riser 9. An ROV secures the leader cable 26 to the end of the automatic connector 25, the leader cable having been pre-installed prior to the assembly comprising the foot unit 8, the tendon 6, and the float 5 being put into place. The other end is taken to the surface for connection to a constant tension winch (not shown). The operation of lowering the riser $\mathbf{9}_1$ is performed by maintaining the tension in the cable 26, which tension then causes the end of the automatic connector 25 to pass through each of the guides $\mathbf{23}_1$ in succession. The tension required in the cable 26 to perform this operation increases with increasing angle of inclination of the tower. During installation of the first riser on the tower, the tower will be in a substantially vertical position. After the corresponding SCR has been connected to the FPSO, the SCR will exert a horizontal force on the tower, thereby causing the tower to tilt relative to the vertical towards the FPSO. As successive risers are installed, this angle increases and the tension required in the cable 26 increases in proportion.

The left side of FIG. 3 shows the riser $\mathbf{9}_2$ installed in its guide 22. Its end 30 rests on the top portion of the guide 22 and constitutes the female portion of an automatic connector into which the male portion 31 of said connector is received, the male portion being connected to a bend 32 itself secured to a flexible joint 33 connected to the end of the SCR 3.

Because of the height of the tower in this embodiment, the length of the SCR is shorter than the depth of the water and the SCR is assembled away from the field by the service vessel and then transported hanging down to the FPSO where it is transferred and has its top end connected. Its bottom end fitted with the flexible joint 33, the bend 32, and the male portion 31 of the automatic connector is connected to a cable whose other end is transferred by the ROV to hauling means (not shown) secured to the float and driven by power supplied by or through the ROV, for example. When the cable is hauled from the float, the pipe takes up a catenary shape, and when the male endpiece 31 is close to the corresponding female portion 30, the two portions are united by means (not shown) known to the person skilled in the field of hydraulic and pneumatic connectors. After the SCR 3 has been put into place, an abutment 34 is installed on the float to bear against a collar 35 on the bend 32 so as to take up the horizontal forces generated by the SCR and prevent the assembly and particularly the bend from rotating about the axis 36 of the risers 9.

FIG. 4 is a side view of the foot unit 8 of a multiriser tower and it is constituted by a ballasted baseplate 40 resting on the sea bed 12 and supporting a metal structure having guides 31, and a central flexible joint 42 suitable for receiving the bottom end of the tendon 6. Two risers 9 are shown: on the left of the figure the riser $\mathbf{9}_1$ is connected via the male portion $\mathbf{25}_1$ of its automatic connector to the female portion $\mathbf{44}_1$ of said connector which is secured to the coupling sleeve $\mathbf{11}_1$ leading to underwater pipes (not shown). If subjected to temperature variations, the riser 9 can expand, sliding through the various guides 7 distributed along the tower. At the bottom, movement of the bottom end can reach several meters under extreme variations: thus, the riser $\mathbf{9}_1$ associated with its sleeve $\mathbf{11}_1$ are free to move vertically in the guides $\mathbf{41}_1$ and $\mathbf{49}_1$ secured to the structure of the foot unit 8.

A counterweight system constituted by a weight $\mathbf{48}_1$ and a cable $\mathbf{46}_1$ passing over a pulley $\mathbf{45}_1$ secured to the structure of the foot unit 8 is connected to reinforcement $\mathbf{50}_1$ on the sleeve $\mathbf{11}_1$ via an attachment point $\mathbf{47}_1$. The counterweight is dimensioned so that in the absence of the riser $\mathbf{9}_1$ the sleeve is held in the high position with the reinforcement $\mathbf{50}_1$ coming into abutment with the structure of the foot unit 8 via the guide $\mathbf{49}_1$. This high position is shown in detail on the right of the figure where there is a riser $\mathbf{9}_2$ in the process of being lowered, after the male portion $\mathbf{25}_2$ of the automatic connector has passed through the last guide $\mathbf{41}_2$. The cable 26 which is kept under tension from the surface and which was used to haul the end of the riser through the various guides has been disconnected by the ROV. The riser $\mathbf{9}_2$ is then caused to move down until the male portion $\mathbf{25}_2$ is received in the female portion $\mathbf{44}_2$. During this engagement stage, the sleeve $\mathbf{11}_2$ remains in its high position since the counterweight $\mathbf{48}_2$ is dimensioned to support at least the sleeve's own weight plus the vertical force required for the engagement stage. After engagement has occurred, the riser 9 can move down until its top portion rests against the float, with the sleeve 11 then being in its low position and the counterweight being lifted correspondingly.

Thus, in the event of future work requiring the riser $\mathbf{9}_2$ to be removed, the ROV will unlock the automatic connector $\mathbf{25}_2$–$\mathbf{44}_2$ and during extraction of the riser, the sleeve will return to its high position because of the action of the counterweight $\mathbf{48}_2$. The riser $\mathbf{9}_2$ will be reinstalled after being repaired in the same manner as it was installed initially since the apparatus of the system of the invention is entirely reversible.

Figure 9:
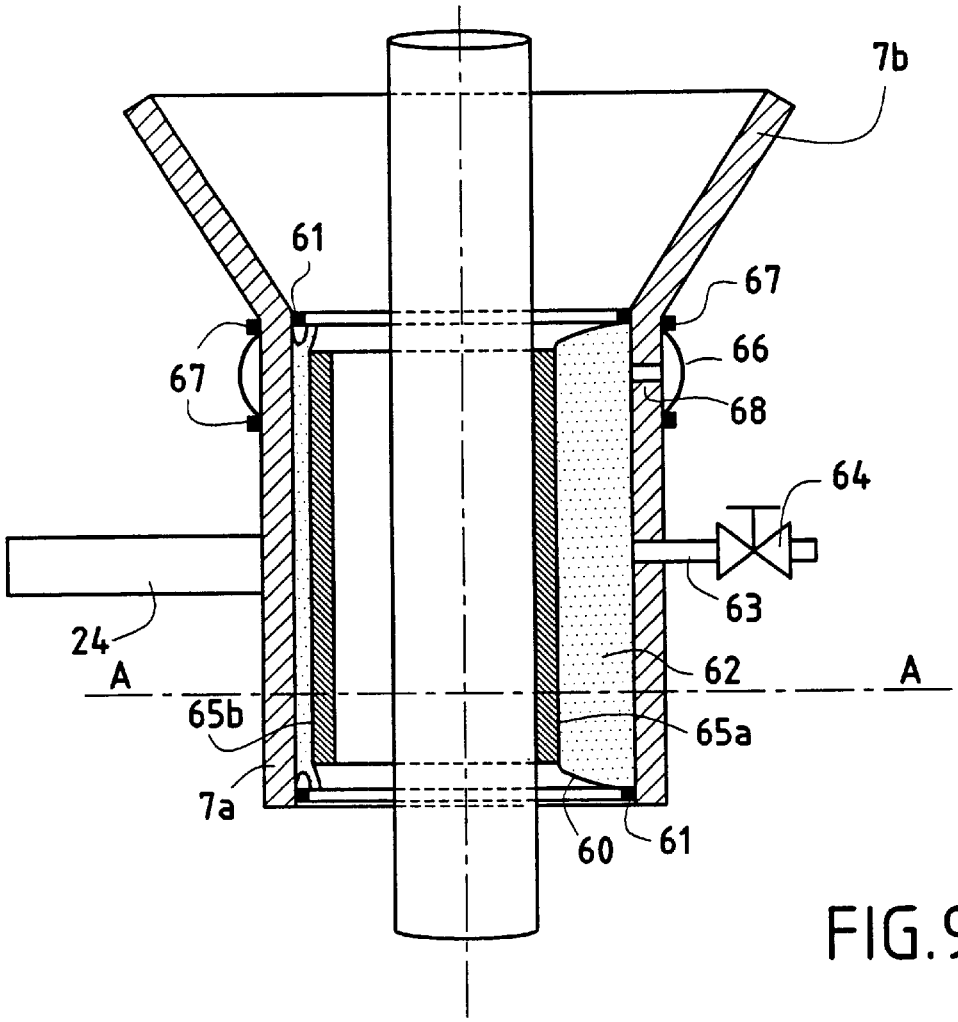
FIG. 9 is a side view in section of one of the riser guides shown in FIG. 3.
Figure 10:
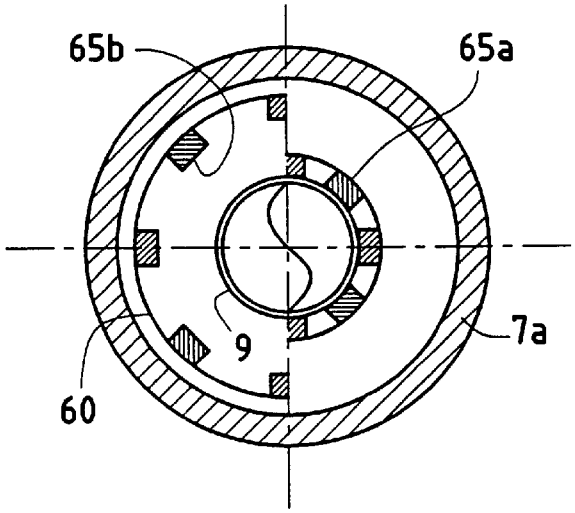
FIG. 10 is a plan view in section on AA of FIG. 9.

FIGS. 9 and 10 show details of the guide means 7 for a riser 9, said guide means being secured via a fastener piece 24 to a tendon 6 (not shown). The guide means 7 is constituted by a cylindrical tube 7*a* surmounted by a conical funnel 7*b* for guiding the male portion of an automatic connector (not shown) while the riser is being put into place. Since the diameter of said connector is greater than that of the riser 9, the guide must be of a diameter that its considerably greater than that of the riser 9. In order to limit and damp lateral movements of the riser in operation, the guide means 7 is advantageously provided with a device of adjustable diameter enabling the inside diameter of the cylindrical tube 7*a* to be adjusted. During the operation of installing or removing a riser, the device is fully retracted so that the cylindrical tube 7*a* presents a maximum diameter, and the device is fully expanded when the riser is in an operational configuration.

The adjustable device is constituted by a flexible membrane 60 secured to the cylindrical guide means 7*a* via top and bottom crimping rings 61, thereby establishing a sealed bag 62 capable of receiving a fluid via an orifice 63 provided with an isolation valve 64. A multitude of shoes 65*a*–65*b*, e.g. six or eight shoes, are secured to the membrane 60 and bear against the riser 9 when the bag 62 is completely filled. In both FIGS. 9 and 10, the left side of the figure shows the membrane 60 associated with the shoe 65*b* in its retracted position, whereas the right side of the figure shows it associated with the shoe 65*a* in the active position, i.e. in contact with the riser. The bag 62 is in communication with an external chamber defined by a membrane 66 which is itself sealed by two hoops 67, an orifice 68 putting the two chambers into communication with each other. Thus, when the bag 62 is emptied of its content by sucking out the fluid through the valve 64, both membranes 60 and 66 are pressed against the cylindrical guide 7*a* and the multitude of shoes 65 are fully retracted, thereby leaving a passage of maximum dimensions. When the riser is in place, filler fluid is pumped in through the valve 64 until the outer membrane is inflated by the pressure. Said valve is then closed and a centering effect is obtained, with it being possible to adjust the force merely by injecting an additional volume of fluid so as to inflate the outer membrane further, which membrane acts as a pressure vessel, i.e. provides a supply of pressure. By using a fluid having very high viscosity, such as an optionally-filled tacky grease, the assembly can act as a damper by absorbing energy, thereby avoiding the appearance of vibratory phenomena in the riser when subjected to the effects of current. The stages of inflating, deflating, or adjusting the pressure are performed by using the manipulator arms and the pumps on board service ROVs. The output membrane 66 acts as a visual indicator, thus making it possible without additional means to observe the guidance state of the damper, merely by inspecting it by using the cameras available on the ROVs.

Figure 5:
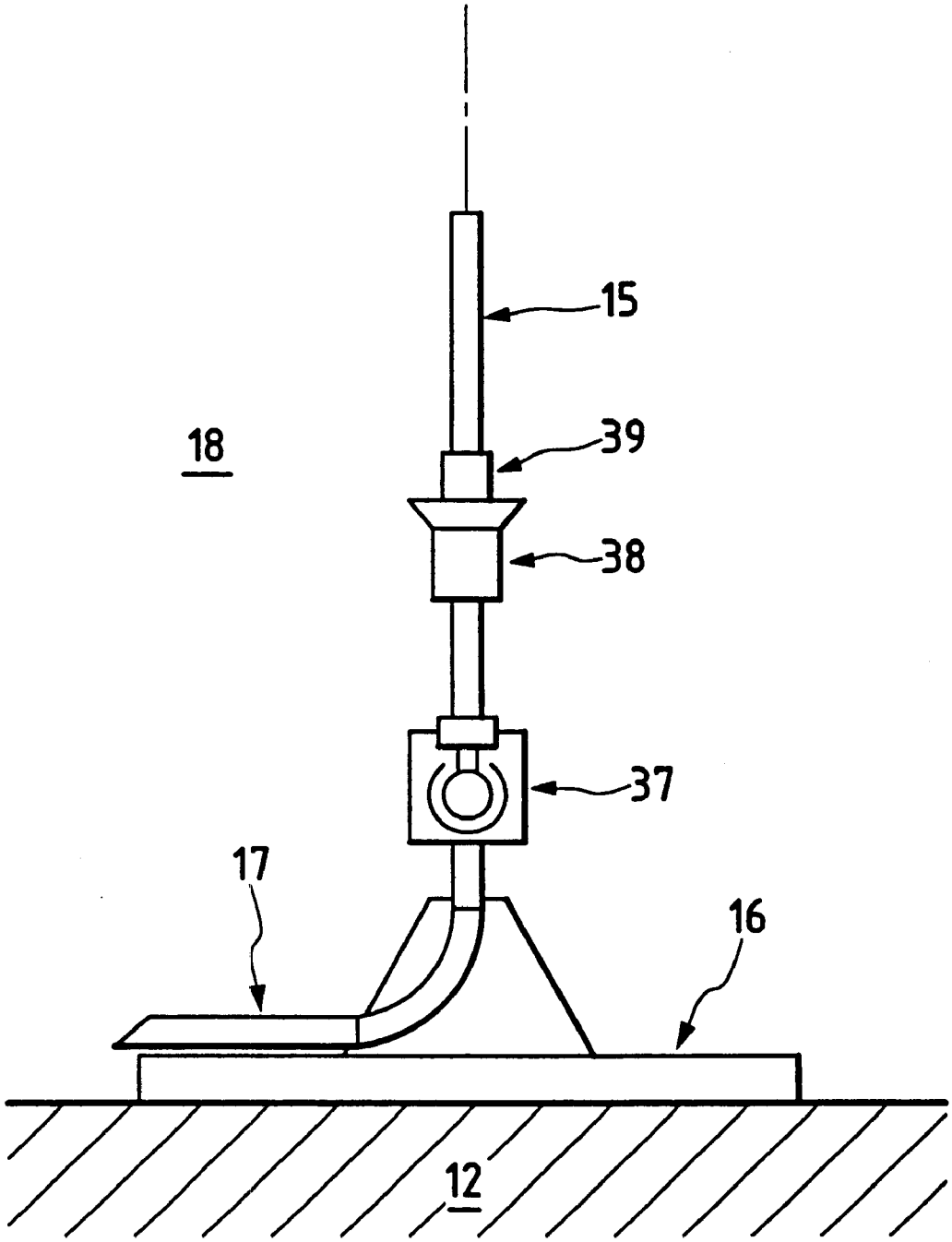
FIG. 5 is a side view of the foot unit of a tower having a single riser.

FIG. 5 is a side view of the bottom portion of a single-riser tower constituted by a foot unit 16 resting on the sea bed 12 and supporting a bent coupling sleeve 17 having a flexible joint 37 installed at its end, the joint in turn being connected to the female portion 38 of an automatic connector. The base of the riser 15 is fitted with the male portion 39 of the same automatic connector. In this embodiment of a system of the invention, the riser 15 also acts as a tendon, and the automatic connector 38–39 together with the flexible joint 37 are dimensioned so as to be able to take up the tension generated by the fluid under pressure plus the tension created by the float 14 and the conditions surrounding the assembly comprising the SCR 4 and the tower.

Figure 6:
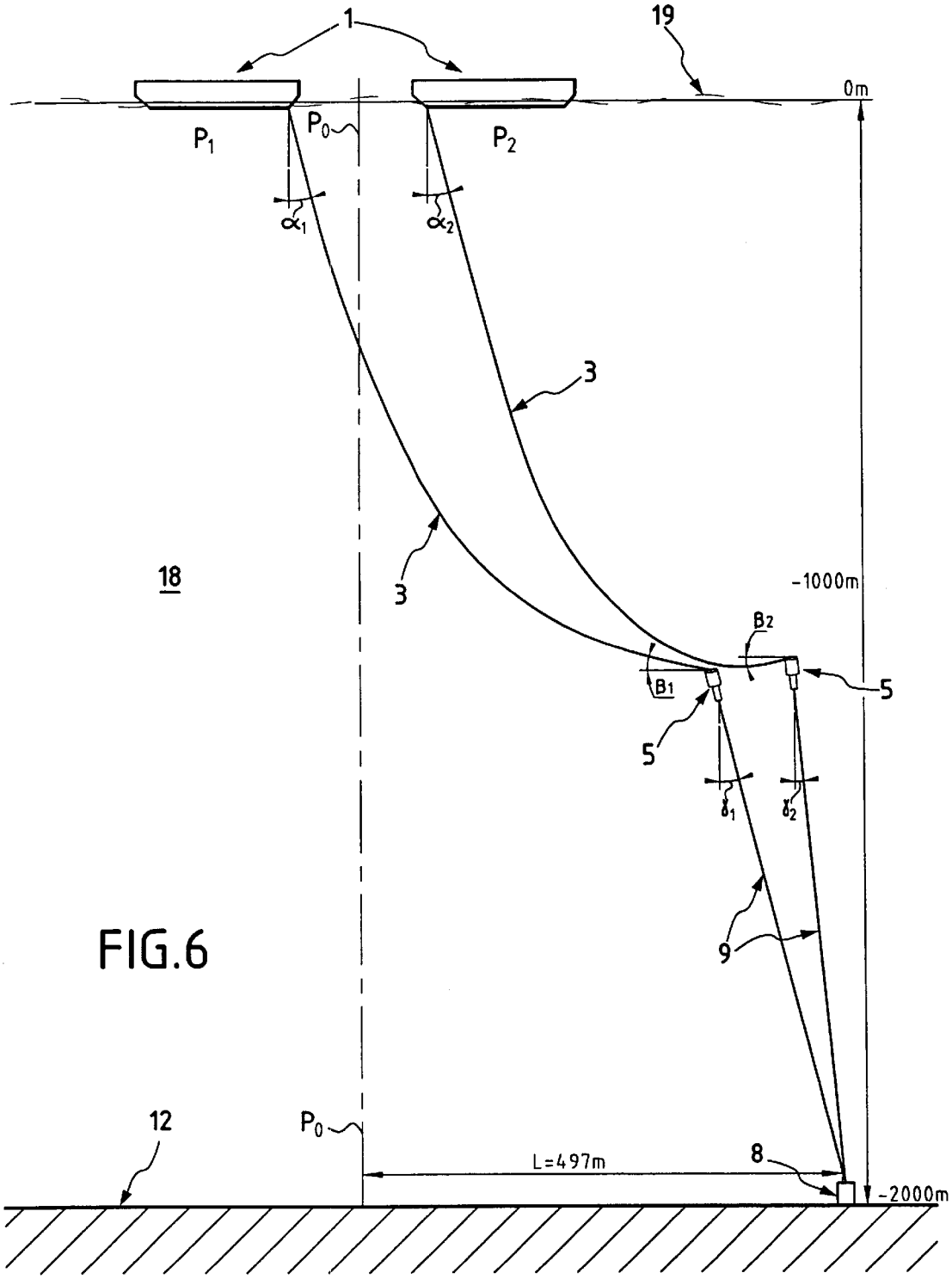
FIG. 6 is a diagram showing the results of static calculations for a turret-anchored FPSO in water having a depth of 2000 m, and connected to a tower of the invention situated at a depth of 1000 m.

FIG. 6 is a diagram showing two positions of a turret-anchored FPSO, and obtained using the results of static calculations, i.e. ignoring dynamic effects, for an oil field at a depth of 2000 m and with a float 5 of a tower of the invention positioned at a depth of 1000 m. The apparent linear weight in water of the SCR 3 and of the single vertical riser 9 acting as a tendon, and both assumed to be full of oil, was taken to be 97.96 kg/m, and the net buoyancy at the float 5 was taken to be 180 metric tonnes (buoyancy of the float minus the apparent weight in water of the float 5, the tendon, and the vertical riser(s) 9). The SCR 3 and the vertical riser 9 are made of the same material and have the same type of configuration, e.g. a diameter of 10.25 inches (") and a thickness of 1", with longitudinal stiffness being assumed to be infinite and with given insulation. The sea water was considered as having a density of 1033 kg/m$^3$.

The mean position of the FPSO 1 is $P_0$, and the results of the calculations give the characteristics of a far position $P_1$ and of a near position $P_2$, corresponding to a maximum excursion of 8% of the water depth of 2000 m, the float 5 being positioned at a depth equal to about half the total depth of the water and being connected to the bottom 12 by a riser 9 having a length of 1014 m.

At the far position $P_1$ the minimum radius of curvature of the SCR 3 is 506 m with a top angle $\alpha_1$ of 19° for tension of 157 tonnes, and a bottom angle $\beta_1$ of 15° for horizontal tension of 51 tonnes; the developed length of the SCR 3 is 1322 m for the float 5 immersed at 1019 m; the top angle $\gamma_1$ of the riser 9 under tension is 15° and the horizontal distance of the FPSO 1 to the foot unit 8 of the riser is 1027 m.

For the near position $P_2$, the minimum radius of curvature of the SCR 3 is 300 with a top angle $\alpha_2$ of 13° for a tension of 133 tonnes, and a bottom angle $\beta_2$ of −10° for a horizontal tension of 30 tonnes, the developed length of the SCR 3 is naturally the same as in the above position, i.e. 1322 m, and the float 5 is immersed at a depth of 1000 m; the top angle $\gamma_2$ of the riser 9 under tension is 9.6° and the horizontal distance from the FPSO 1 to the foot unit 8 is 868 m, while the distance to the mean position $P_0$ is L=947 m.

Figure 7:
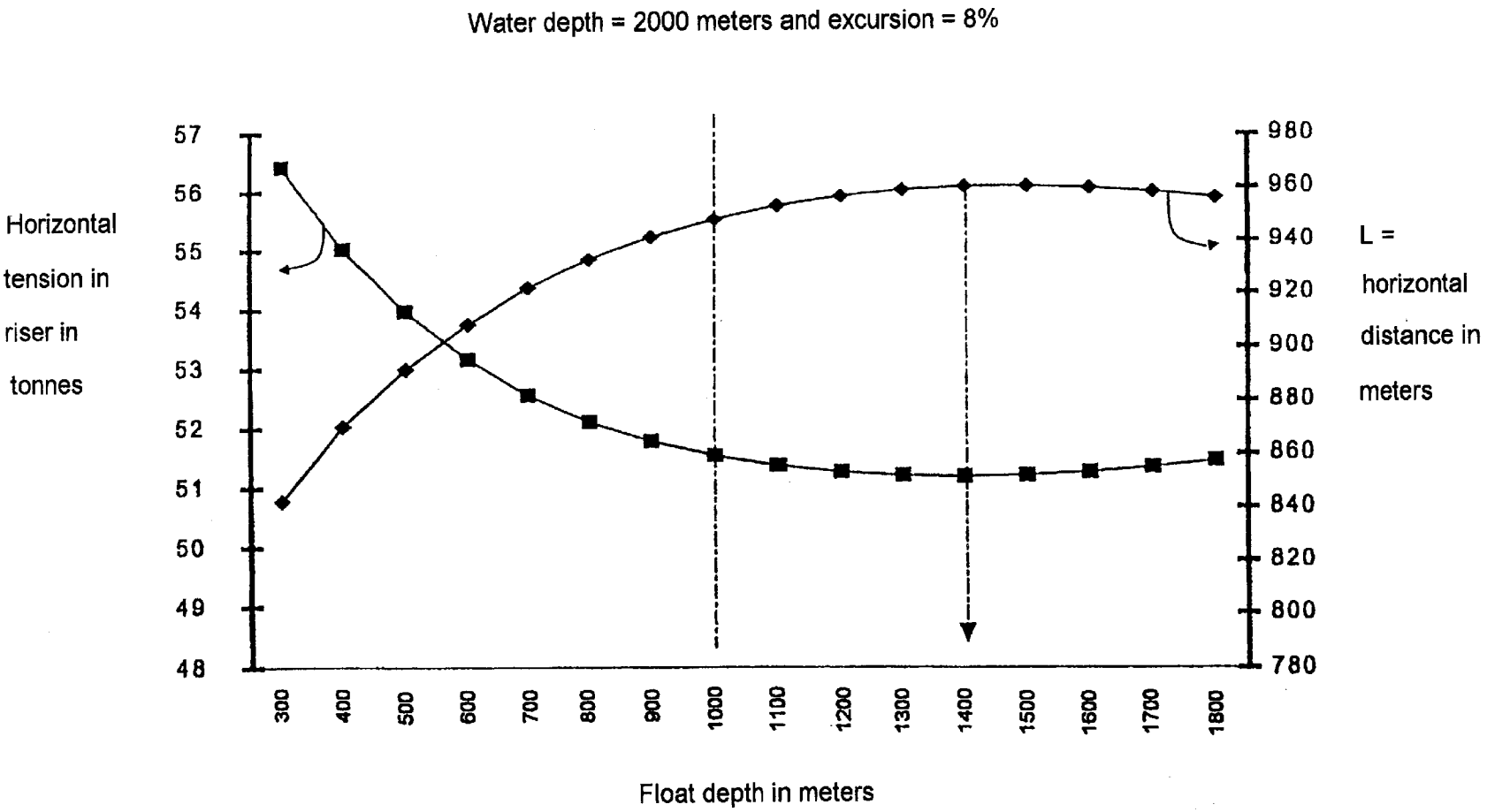
FIG. 7 is a plot of two curves representing variations in horizontal tension and in the horizontal distance between the anchoring foot unit and the FPSO float as a function of the depth of the float in water having a depth of 2000 m, and for an excursion of 8%.

On the basis of the assumptions described in detail with reference to FIG. 6, FIG. 7 shows how horizontal tension and the distance L between the foot unit 8 and the FPSO 1 vary as a function of the depth of the float 5. It can thus be seen that for an increase in the depth of the float 5, the horizontal tension decreases, presenting a minimum at −1400 m. In addition, for a depth lying in the range −1000 to −1800 m, tension lies in the range 52 tonnes to 53 tonnes, and is thus substantially constant. Similarly, the distance L to the FPSO 1 has a maximum value at −1400 m and remains substantially constant around 950 m to 960 m for a depth lying in the range −1000 to −1800 m. Thus, if two towers are installed at substantially the same distance from the FPSO with floats that are situated at depths that are very different, their performance will be similar, but the very different SCRs will not run any risk of interfering with each other.

Figure 8:
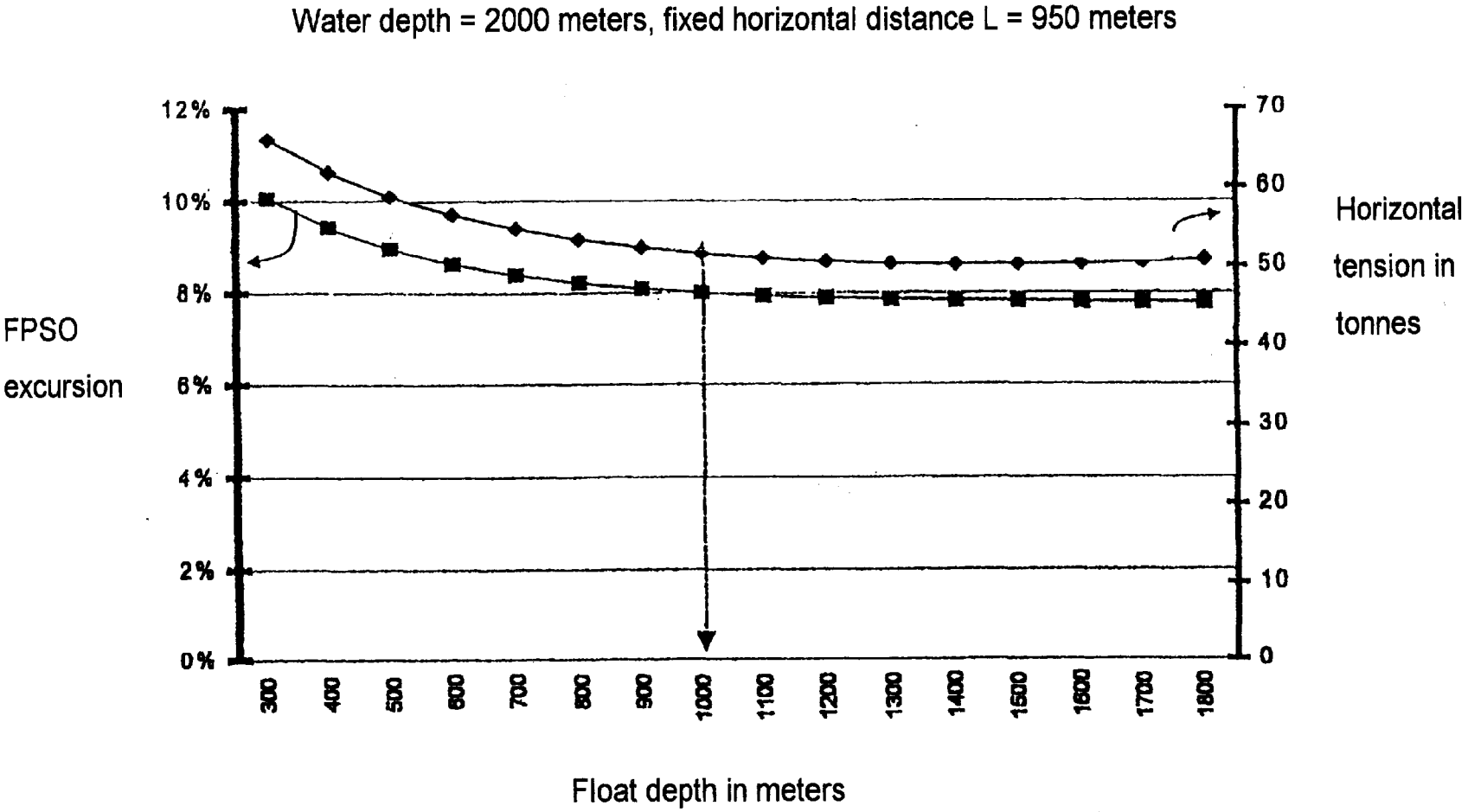
FIG. 8 is a plot of two curves showing variations in the excursion of the FPSO and in horizontal tension as a function of the depth of the float for a water depth of 2000 m and for a distance between the FPSO and the buoy of 950 m.

On the basis of the assumptions described with reference to FIG. 6, FIG. 8 shows variations in the excursion of the FPSO and in horizontal tension as a function of the depth of the float 5 and for the distance between the FPSO 1 and the foot unit 8 being 950 m (position $P_0$). The calculations were performed on the basis of an excursion of 8% corresponding to a float depth of 1000 m. When designing oil fields, it is common practice to consider that maximum excursion does indeed correspond to 8% of the water depth, which corresponds to 160 m for water having a depth of 2000 m. It can thus be seen that for a reduction in the depth of the float 5, the maximum excursion and the horizontal tension tend to increase whereas for an increase in said depth, excursion remains stable at around 8% and tension remains stable at around 50 tonnes. It thus appears that for depths in excess of 1000 m, maximum excursion and tension remain stable and static. This thus constitutes an invariant of the system, which invariant had a stabilizing effect for the system which is subjected to dynamic effects.

Thus, in the invention, locating the float 5 at a depth of more than half the depth of the water presents a great advantage for the stability of the system and thus for its fatigue behavior during the lifetime of the field.

It thus appears that in order to develop fields that require a multitude of towers, a large amount of latitude can be made available as to the positioning of the floats by locating the floats in the bottom half of the water depth, thereby giving rise to small variations in horizontal forces and in tower-to-FPSO distance. By proceeding in this way, it is possible to position a multitude of tower-and-SCR assemblies in three dimensions while avoiding interference between the floats and interference between the SCRs, thereby increasing the safety and the performance of installations during the lifetime of the field.

In all of the descriptions of systems in accordance with the invention, the male and female portions of the automatic connectors have been described in one given position, but they could be inverted without changing the character of the invention. Similarly, the position of the automatic connector and the adjacent flexible joint can be interchanged without changing the character of the invention.

In general, a tower increases the capacity of the FPSO for excursion around its mean position while an SCR of large dimensions improves the damping of the system. The mathematical curve represented by the catenary taken up by a pipe of linear mass and of constant bending stiffness presents constant variation in its curvature starting from the FPSO and going towards the float, which curvature has a minimum value (maximum radius of curvature) at the FPSO and then increases towards a maximum value (minimum radius of curvature) at the float. The FPSO which is subjected environmental conditions will transmit its movements to the assembly constituted by the SCR(s) and the tower. The excitation of the SCR will lead to overall movements of said SCR, giving rise to local variations in radius of curvature, which in turn will generate transverse movements having the effect of absorbing a portion of the energy. Thus, large-size SCRs absorb a maximum amount of energy over their entire length and the amount of excitation energy transferred to the float is reduced to a minimum. Thus, seen from the tower, the SCR acts as a filter for filtering out the excitation movements generated by the FPSO.

The tower which is favorable for improving excursion capacity for small angular variations is nevertheless a poor damper, and in addition it is subjected to vibrations generated by turbulent phenomena (vortexes), which is why the system of the invention consists in installing the tower and its float at great depth in a zone where currents are stable and where vortex effects are small.

Thus, for an oil field, e.g. installed in 1500 m of water, and with a tower that is short, e.g. situated 100 m above the bottom, an SCR having a length of about 1400 m will behave relative to the FPSO like a conventional SCR while nevertheless avoiding the drawbacks that exist in the prior art and that are associated with the formation of dirt at the point of contact and with the risk of damaging the SCR in this region. The presence of hinge joints at the FPSO and at the float of the tower facilitates excitation of the catenary, thereby leading to energy absorption and thus to overall damping, while minimizing the transmission of forces at the ends, i.e. both at the FPSO and at the float of the tower, because neither end is built in.

A tall tower is preferred when it is desired to have a high performance insulation system such as the pipe-in-pipe system. The pipe-in-pipe concept is constituted by two concentric pipes with an insulation system installed between them. The insulation system can be polyurethane foam, syntactic foam, or indeed a gas at an absolute pressure that can lie in the range bottom pressure, for example, to absolute vacuum, where absolute vacuum provides the best performance in terms of insulation. On this topic, it is recalled that syntactic foam is constituted by microspheres, generally made of glass, embedded in a matrix of durable material of the epoxy or polyurethane type. Such a pipe-in-pipe system is expensive and rather complex to implement since it is generally made up of elements that are 12 m or 24 m long and that are assembled together by welding or by screwing. Although it is particularly suitable for the risers of the tower, it is more difficult to use in SCRs, and at medium depths it is preferred to use insulation systems that are stronger but of lower performance and less expensive, such as shells of syntactic foam. Thus, with a tall tower, expensive but high performance pipe-in-pine technology is implemented, but only within the tower, thereby obtaining maximum guarantees in terms of lifetime since the tower is located in the calmest region of the water depth. In the top portion, SCRs are used that are associated with insulation systems of lower performance in thermal terms, but more suitable for withstanding environmental conditions during the lifetime of the installation, and this is obtained at considerably lower cost. Thus, the fluid reaches the foot of the tower at a temperature of 55° C., for example, and will lose a few degrees, e.g. 4° C. to 5° C. on travelling up the tower, with this being due essentially to the effluent losing pressure as it travels over 45%, for example, of the water depth, while travelling over the remainder of the water depth, i.e. 55%, in the SCR it will lose a few more degrees, e.g. 7° C. to 9° C. due in part to the lower-performance insulation and in part to the effluent losing pressure. In the example cited, the fluid will thus have lost a total of 11° C. to 14° C. while using two insulation systems having very different levels of performance, since the looked-for objective is to optimize the overall insulation on the basis of criteria relating to lifetime and cost.

A tall tower is also preferred when there is a tendency for gas plugs to form in the rising column. Such plugs are followed by a liquid front that can move at very high speed, giving rise in erratic manner to internal phenomena of the water hammer type. These phenomena strike the SCR and rise to the FPSO, giving rise to internal pressure fronts within the fluid. Such hammer within the vertical risers can give rise to forces of several tonnes at the ends. These forces will become manifest at the float, but since its total mass can be 100 tonnes to 200 tonnes, the consequences of such phenomena in the system of risers insignificant. It is thus considered that the effects of such hammer are second-order effects when they occur in the vertical tower, whereas they are first-order effects when they occur within an SCR of the same height.

Thus, and in general, in effluent production configurations and particularly those that require insulation, it is advantageous to use tall towers.

When water is injected, which is done with a fluid stream that is very stable and which consequently does not give rise to hammer phenomena, it is preferable to install a short tower so as to come closer to the configuration of a simple SCR resting on the sea bed, while nevertheless avoiding the above-described drawbacks of the prior art.

Under these circumstances, it is advantageous for the central tendon to be replaced by a pipe through which the injection water travels. Injection water risers are generally provided in very small numbers and they are connected at the sea bed via multiple branches from which underwater pipes extend to water injection wells. Such a tendon-pipe performs two functions, and although this option is indeed possible when producing petroleum effluents, it is not desirable since maintenance operations then require the entire float-pipe-tendon assembly to be dismantled.

Oil fields are often developed in sequence over several years as wells are drilled and well heads are installed. The system of the invention makes it possible advantageously to install around the FPSO a multiplicity of mutually independent towers situated at various depths, which present the advantage of locating the foot of each tower at horizontal distances from the FPSO that can be larger with increasing depth of the float. This disposition makes it possible to cause a large number of underwater pipes to converge on each tower foot without interfering with the feet of adjacent towers or the underwater pipes associated therewith.

What is claimed is:

1. A bottom-to-surface link system for an underwater pipe installed on the sea bed at great depth, the system comprising a vertical tower constituted by at least one float associated with an anchor system and carrying at least one vertical riser having a top end connected to said float and a bottom end capable of being connected to said underwater pipe installed on the sea bed, and at least one link pipe from said float to a surface support, wherein each said link pipe is a riser whose wall is a rigid strong tube, each said link pipe forming a catenary curve having a radius of curvature which increases continuously from said float to said surface support.

2. A link according to claim 1, wherein said float is installed at a at a depth of more than 500 m.

3. A link system according to claim 2, wherein said float is installed at a depth that is greater than half the water depth in which the tower is anchored.

4. A link system according to claim 1, wherein the anchor system comprises at least one vertical tendon, a bottom foot unit to which the bottom end of the tendon is fixed, and at least one guide through which the bottom end of the vertical riser passes.

5. A link system according to claim 4, wherein the bottom end of the vertical riser is suitable for being connected to the end of a connection sleeve bend that is movable between a high position and a low position relative to said foot unit, the sleeve being suspended from said foot unit and being associated with return means urging it towards a high position in the absence of a riser.

6. A system according to claim 4, wherein that said tendon has guide means distributed along its entire length and through which at least said vertical riser passes.

7. A system according to claim 6, wherein said guide means comprise a cylindrical cavity surmounted by a conical funnel, the inside diameter of said cylindrical cavity being greater than the diameter of the vertical riser, and said guide means including a flexible membrane secured to the inside wall of said cylindrical cavity, thereby creating a leakproof bag between said membrane and said inside wall, which bag can be filled with a fluid so as to press against the riser.

8. A system according to claim 7, further comprising friction shoes associated with said membrane and bearing against the riser when said bag is filled with fluid.

9. A system according to claim 1, wherein the top end of said vertical riser is suspended through at least one guide secured to said float, said link pipe having a bent end connected to said guide.

10. A link system as in claim 1 wherein said link pipe is a steel catenary riser.

11. A link system as in claim 1 wherein said radius of curvature is greater than 100 m throughout the length of said link pipe.

12. A bottom-to-surface link method for an underwater pipe installed on the sea bed at great depth, the method comprising providing a vertical tower constituted by at least one float associated with an anchor system and carrying at least one vertical riser having a top end and a bottom end suitable for going down to the sea bed, installing said float at a depth situated beneath the last thermocline, and connecting said float to said surface support by at least one link pipe having a wall which is a rigid strong tube and forming a catenary curve having a radius of curvature which increases continuously from said float to said surface support.

13. A link method according to claim 12 comprising connecting said float to said surface support via at least one steel catenary riser constituting said link pipe.

14. A link method according to claim 12 comprising installing a foot unit having a preinstalled connection sleeve on the sea bed with a tendon having a bottom end fixed to said foot unit and a top end secured to said float, the foot unit and the tendon constituting said anchor system of the vertical tower; and lowering said vertical riser progressively from the surface and through a guide assembly of said float until the top end of said riser bears against said float and the bottom end of said riser comes into connection with the connection sleeve preinstalled on said foot unit.

15. A link method according to claim 14, comprising preassembling the entire vertical riser and transporting the riser in the vertical position to vertically above the corresponding guide of the float.

16. A link method according to claim 12 comprising installing said float at a depth that is greater than half the depth of the water in which the tower is anchored.

17. A link method as in claim 12 comprising installing said float at a depth of more than 500 m.

18. A link method as in claim 12 wherein said radius of curvature is greater than 100 m throughout the length of said link pipe.

* * * * *